United States Patent [19]

Katagiri et al.

[11] Patent Number: 4,520,864

[45] Date of Patent: Jun. 4, 1985

[54] YEAR-ROUND AIR CONDITIONER WITH EVAPORATOR BAND AND SPECIAL HEATER PLACEMENT

[75] Inventors: Nobuhiko Katagiri, Maebashi; Hidenobu Matsubara, Shibukawa; Akio Iida, Maebashi, all of Japan

[73] Assignee: Toshiba Electric Appliances Co., Ltd., Maebashi, Japan

[21] Appl. No.: 498,653

[22] Filed: May 27, 1983

[30] Foreign Application Priority Data

May 29, 1982 [JP] Japan ..... 57-91881

[51] Int. Cl.[3] ..... F24F 3/14

[52] U.S. Cl. ..... 165/60; 62/314; 165/86; 219/367; 219/368; 261/142

[58] Field of Search ..... 165/126, 60, 86; 237/78 R; 261/80, 142; 219/367, 368; 236/44 C; 62/314

[56] References Cited

U.S. PATENT DOCUMENTS

| | | | |
|---|---|---|---|
| 2,147,283 | 2/1939 | Covell | 165/96 X |
| 2,231,797 | 2/1941 | Carson | 165/126 |
| 2,310,086 | 2/1943 | Howard | 165/86 |
| 2,800,306 | 7/1956 | Freeman | 165/60 X |
| 2,914,648 | 11/1959 | Allander | 219/367 X |
| 3,394,755 | 7/1968 | Morrison | 165/126 |
| 3,869,529 | 3/1975 | Follette | 236/44 C X |
| 3,951,625 | 4/1976 | Follette | 236/44 C X |
| 4,316,077 | 2/1982 | Carlson | 219/367 X |

FOREIGN PATENT DOCUMENTS

| | | | |
|---|---|---|---|
| 2900983 | 7/1979 | Fed. Rep. of Germany | 219/367 |
| 1445816 | 8/1976 | United Kingdom | 165/86 |

*Primary Examiner*—Stephen F. Husar

*Attorney, Agent, or Firm*—Schwartz, Jeffery, Schwaab, Mack, Blumenthal & Koch

[57] ABSTRACT

A compact, self-contained cooling-heating-humidifying-filtering apparatus has an endless band of water-absorbent, air-permeable material traveling in partial immersion in water contained in a receptacle within a conditioner housing. A fan produces a continuous air-stream from an air inlet to an air outlet, both defined in the housing, through the endless band. A damper is provided in order to divide the air outlet into a cool air outlet and a warm air outlet. The damper is operated by a hand lever so as to selectively communicate the cool and warm air outlets with the air inlet. An electric heater is disposed at the warm air outlet or, preferably, on one of the opposite surfaces of the damper for heating the air flowing through the warm air outlet. This location of the heater serves to assure noiseless cooling operation and to permit the heater to heat effectively, despite its limited capacity, the air flowing through the warm air outlet.

8 Claims, 5 Drawing Figures

YEAR-ROUND AIR CONDITIONER WITH EVAPORATOR BAND AND SPECIAL HEATER PLACEMENT

BACKGROUND OF THE INVENTION

This invention relates to air conditioners in general and, in particular, to a year-round air conditioner of compact design with air cooling, air heating, humidification, and filtration capabilities. Still more particularly the invention pertains to improvements in a year-round air conditioner of the type incorporating an endless band of porous material traveling in partial immersion in water to provide for air cooling and humidification.

Japanese Utility Model Laid-Open No. 151671/1977 and U.S. Pat. No. 3,476,365 represent examples of prior art air conditioners of the class in question. The Japanese utility model application proposes a device primarily for use as an air cooler. A fan-induced airstream passes the wetted endless band of porous material thereby to be cooled by virtue of the latent heat of vaporization of the water. The fan subsequently expels the thus-cooled air out into the room or like space to be conditioned.

The device according to the above cited U.S. patent, on the other hand, is intended for use as an air humidifier. The device of the U.S. patent also has a wetted endless band traveling between two separated rolls, the lower end of the band being immersed in water contained in a water tank.

If an electric heater is built into these devices with suitable controls, they function as simple year-round air conditioners. Japanese Utility Model Laid-Open No. 175920/1982, filed by the assignee of the instant application and published Nov. 6, 1982, suggests an example of such year-round air conditioners. A brief study of the device disclosed therein will manifest the problems to be solved by the present invention.

The year-round air conditioner disclosed in the just-mentioned Japanese application includes an endless band of porous material extending between and traveling around a pair of spaced rolls, one of which lies in a water receptacle on the bottom of the conditioner housing so that the porous band is constantly moistened. A fan draws ambient air into the housing through an air inlet in its back wall. The incoming air passes the moist traveling band and is expelled through an air outlet in the front wall of the housing. Disposed between the porous band and the fan is an electric heater with a guard screen for the protection of the band from the heater. The heater is, of course, set in operation for the production of warm air and out of operation for the production of cool air.

An objection to this known year-round air conditioner is the arrangement of the heater, together with the guard screen, between the porous band and the fan. During cooling, the heater with the guard screen serves no useful purpose but only obstructs the flow of cool air from the porous band toward the air outlet, thus giving rise to noise.

Another problem of this device arises by reason of the limited capacity of the electric heater, limited because it is fed from commercial household power supply (e.g. at 100 volts). Lying in the large space between the porous band and the fan, the heater has been incapable of heating the airstream to a required temperature range if its flow rate is high. Thus the flow rate of air has had to be reduced during heating.

SUMMARY OF THE INVENTION

It is an object of this invention to provide a year-round air conditioner having a noise level lower than that of year-round air conditioners of the type above indicated, particularly during cooling.

Another object of this invention is to provide a year-round air conditioner capable of producing sufficiently warm air at a desired rate despite the limited capacity of the heater incorporated therein.

Basically, the invention provides a year-round air conditioner including a housing having an air inlet and an air outlet defined therein. Disposed within the housing is a wet band assembly comprising an endless band of water-absorbent, air-permeable material extending around a pair of parallel spaced rolls. The endless band is positioned to be held partly immersed in water in a water receptacle, thereby to be constantly wetted, and to intervene between the air inlet and air outlet in the housing. A fan produces an airstream from the air inlet to the air outlet through the endless band of the wet band assembly. At the air inlet a damper is provided which divides the same into a cool air outlet and a warm air outlet and which is actuatable for selectively communicating the cool and warm air outlets with the air inlet. A heater is disposed substantially at the warm air outlet for heating the air being expelled therethrough.

Thus, during cooling, the heater is out of the way of the airstream from air inlet to cool air outlet. No screen or the like is required for guarding the wet band assembly from the heater. Consequently the air conditioner can produce the cool air with much less noise than heretofore. During heating, on the other hand, the heater positioned substantially at the warm air outlet can effectively heat the air flowing therethrough despite its limited capacity, the warm air outlet being smaller than the space between endless band and fan where the heater has conventionally been arranged. The word "substantially" is used because the heater may be mounted on the damper, as in the preferred embodiment disclosed herein.

Also in the disclosed embodiment the air inlet in the housing is closed with a filter screen, and the endless band itself functions as air filter as well. Further, the wet band assembly may be set either in or out of operation as desired. Accordingly, the air conditioner serves as a self-contained cooling-heating-humidifying-filtering unit for the most effective comfort air conditioning of a room or like space.

The above and other features and advantages of this invention and the manner of attaining them will become more apparent, and the invention itself will best be understood, from a study of the following description and appended claims, with reference to the attached drawings showing a preferred embodiment of the invention.

DETAILED DESCRIPTION OF THE INVENTION

Figure 1:
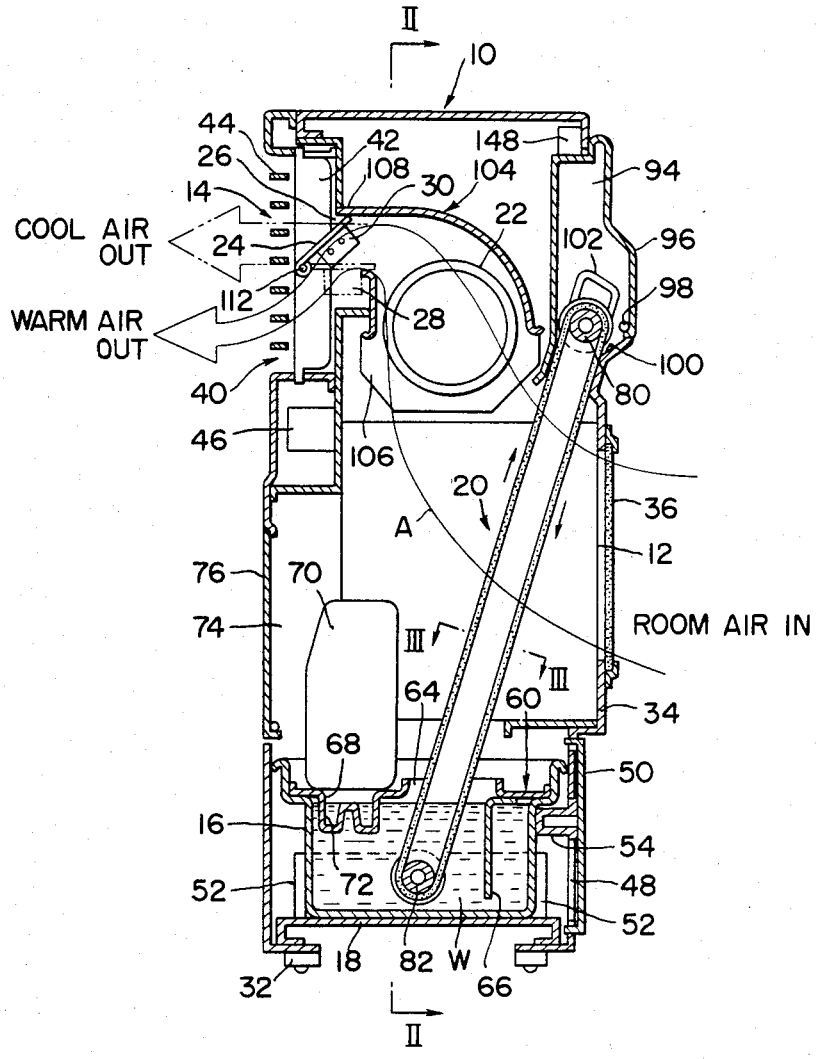
FIG. 1 is a vertical section through a portable, year-round air conditioner constructed in accordance with the novel concepts of the invention.
Figure 2:
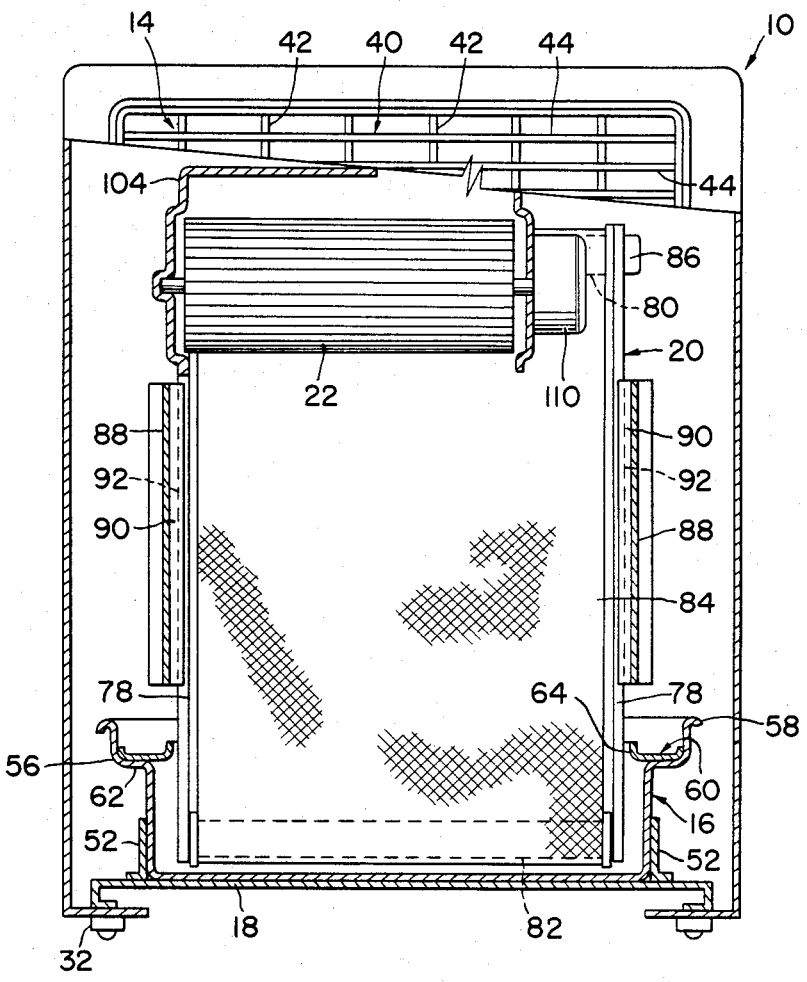
FIG. 2 is a vertical section, partly in elevation, through the air conditioner, taken along the line II—II in FIG. 1.

The general organization of the exemplified year-round air conditioner will become apparent upon consideration of FIGS. 1 and 2. Broadly it comprises:

1. A housing 10 having a filter-screened air inlet 12 and a louvered air outlet 14.

2. A water receptacle 16 withdrawably mounted on the bottom 18 of the housing 10.

3. A wet band assembly 20 also withdrawably mounted within the housing 10 in partial immersion in the water W contained in the receptacle 16.

4. A fan 22 within the housing 10 for producing an airflow A from air inlet 12 to air outlet 14 through the wet band assembly 20.

5. A damper 24 pivotally mounted at the air outlet 14 for dividing the same into a cool air outlet 26 and a warm air outlet 28 and for selectively communicating the cool and warm air outlets with the air inlet 12.

6. An electric heater 30 mounted on the damper 24 for heating the air as it is expelled through the warm air outlet 28.

The housing 10 is of generally boxlike shape, mounted on casters 32 for portability. The air inlet 12 is defined in the rear wall 34 of the housing midway between its top and bottom ends. A filter screen 36 covers the air inlet 12 for removal of dust from the incoming room air.

The air outlet 14, on the other hand, is defined in the front wall 38 of the housing 10 in the vicinity of its top end. This air outlet is fitted with a dual louver assembly 40 comprising a set of vertical slats 42 and a set of horizontal slats 44. During cooling or heating operation of the air conditioner the vertical slats 42 are to be jointly and repeatedly oscillated about their vertical pivots by an electric motor drive unit 46 for correspondingly oscillating the conditioning airstream being discharged through the cool air outlet 26 or warm air outlet 28. The horizontal slats 44 are to be manually turned about their horizontal pivots for varying the angle of the conditioning air-stream either upwardly or downwardly.

Molded of plastic material, the water receptacle 16 is to be inserted in the housing 10 through an aperture 48 in its rear wall 34. A lid 50 openably closes the aperture 48. A pair of guide plates 52 are firmly erected on the bottom 18 of the housing 10, one on each side of the water receptacle 16. Placed on the bottom 18 of the housing through the aperture 48, the water receptacle 16 is to be slid along the pair of upstanding guide plates 52 to its preassigned working position best depicted in FIG. 1. The lid 50 has a pusher 54 projecting interiorly therefrom to butt on the rear wall of the water receptacle 16. Upon closure of the lid 50, therefore, the pusher 54 pushes the water receptacle 16 to its working position.

Open at the top, the water receptacle 16 has its top edge bent outwardly into an L-shaped rim 56 (FIG. 2) for ease of handling by the user. The rim 56 is crimped or curled at 58 for reinforcement. Closing the open top of the water receptacle 16 is a cover 60 which may also be molded of plastics material and which rests on the ledge 62 formed by part of the L-shaped rim 56 of the water receptacle. The cover 60 has an elongate aperture 64 defined therein for the passage of the wet band assembly 20 with considerable clearance. A plate 66 depending from the cover 60 in the vicinity of the aperture 64 functions to minimize the waving of the water W in the receptacle 16 upon exertion of external forces on the air conditioner. Further, the cover 60 is formed to include a depression 68 for the receipt of water from a replenishing vessel 70 removably mounted thereon. This replenishing vessel has a built-in valve mechanism, not shown, whereby the water receptacle 16 is replenished through an opening 72 in the cover depression 68 to keep the water at a constant level.

The housing 10 has an aperture 74 defined in its front wall 38 for the insertion and withdrawal of the replenishing vessel 70 to and from its illustrated working position on the water receptacle cover 60. A hinged or otherwise openable lid 76 normally holds the aperture 74 closed.

Figure 3:
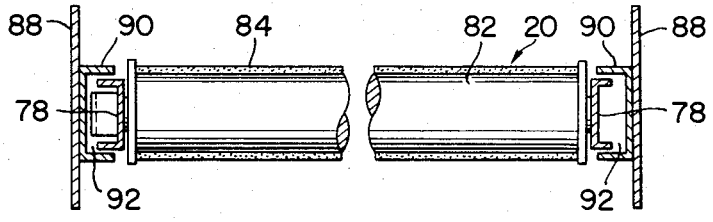
FIG. 3 is an enlarged transverse section, partly broken away for illustrative convenience, through the wet band assembly of the air conditioner, the section being taken along the line III—III in FIG. 1.

The wet band assembly 20 is formed as a discrete unit and is readily withdrawable from within the housing 10 for servicing. As shown in both FIGS. 1 and 2 and on an enlarged scale in FIG. 3, the wet band assembly 20 comprises:

1. A pair of elongate, channeled side frames 78 in parallel spaced relation to each other.

2. A drive roll 80 and an idler roll 82 rotatably mounted at the opposite extremities of the pair of side frames 78.

3. A relatively wide, endless band 84 of generally porous, water-absorbent, air-permeable material, such as that normally used for filtration purposes, wrapped around and extending between the drive and idler rolls 80 and 82.

4. A small motor drive unit 86 (hereinafter referred to as the band motor) mounted on one of the side frames 78 and coupled to the drive roll 80 for imparting rotation thereto and hence for driving the endless porous band 84 in the direction of the arrows in FIG. 1.

On the opposite sides of the wet band assembly 20 there are provided a pair of support plates 88 in fixed relation to the housing 10. A pair of channeled guides 90 are affixed respectively to the opposed surfaces of the support plates 88, sloping rearwardly as they extend upwardly. The wet band assembly 20, or its pair of side frames 78, is to slide along the guideways 92 defined by the channeled guides 90 to and away from its working position indicated in FIGS. 1 and 2. Preferably the side frames 78 of the wet band assembly should have some transverse play with respect to the respective channeled guides 90.

The rear wall 34 of the housing 10 is further apertured at 94, FIG. 1, for the introduction and withdrawal of the wet band assembly 20 to and away from its working position. The aperture 94 is provided with a hinged lid 96 pivotable about a pin 98. Disposed immediately interiorly of the aperture 94 is a slot 100 in alignment with the pair of guideways 92 defined by the channeled guides 90. The wet band assembly 20 has its top end portion held engaged in the slot 100 when it is in the working position. Preferably the pair of side frames 78 of the wet band assembly 20 should have their top end portions flared in order that the wet band assembly may not drop too far into the slot 100. Either or both of these top ends of the side frames 78 may be provided with a handle or handles 102 to facilitate the manipulation of the wet band assembly 20 into and out of the housing 10.

Thus, on being inserted into the slot 100 in the housing 10 through the aperture 94, the wet band assembly 20 slides along the pair of opposed guideways 92 until the flaring top end portions of its side frames 78 become caught at the entrance of the slot 100. In this operating position of the wet band assembly 20, its idler roll 82 lies wholly in the water W in the receptacle 16, so that the endless porous band 84 is partly submerged in the water through the aperture 64 in the receptacle cover 60. As the band motor 86 revolves the drive roll 80, therefore, the porous band 84 travels over the rolls 80 and 82 while being constantly wetted by the water in the receptacle 16.

It will also be observed from FIG. 1 that the wet band assembly 20 intervenes between air inlet 12 and air outlet 14 in the housing 10. Consequently the airflow A, induced by the fan 22, passes the porous band 84 on its way from air inlet 12 to air outlet 14.

The fan 22 is mounted within a curved, tapering air duct 104 which functions to guide the airflow A from the wet band assembly 20 to the air outlet 14. The air duct 104 has a larger entrance end 106 open toward the wet band assembly 20 and a smaller exit end or air passage 108 open toward the air outlet 14. The fan 22 lies at or adjacent the entrance end 106 of the air duct 104. Mounted exteriorly of the air duct 104, on one side thereof, is a motor drive unit 110 for the fan 22. This motor drive unit will hereinafter be referred to as the fan motor in contradistinction to the band motor 86.

With reference to FIG. 1 the damper 24 extends horizontally across the air outlet 14 and so partitions the same into the upper, cool air outlet 26 and the lower, warm air outlet 28. Arranged at or adjacent to the exit end or air passage 108 of the air duct 104, the damper 24 pivots about a horizontal axis at 112 for selectively communicating the cool air outlet 26 and warm air outlet 28 with the air inlet 12 in coaction with the air duct. FIG. 1 indicates the two operating positions of the damper 24 by the solid and phantom lines. In the solid-line slanting position the damper 24 places the warm air outlet 28 in communication with the air inlet 12. When pivoted clockwise to the phantom horizontal position, on the other hand, the damper 24 establishes communication between the cool air outlet 26 and air inlet 12.

The electric heater 30 is mounted on that surface of the damper 24 which is directed downwardly when the damper is in the horizontal position in this particular embodiment. The heater 30 is to be energized only when the damper 24 is in the slanting position, heating the air-stream A being discharged through the warm air outlet 28. In the horizontal position of the damper 24, on the other hand, the heater 30 is held deenergized and retracted away from the path of the airstream flowing through the cool air outlet 26.

Such energization and deenergization of the heater 30 take place automatically as the damper 24 is manually activated between its two working positions. The following description will make clear how the heater 30 is automatically set into and out of operation with the pivotal motion of the damper 24.

Figure 4:
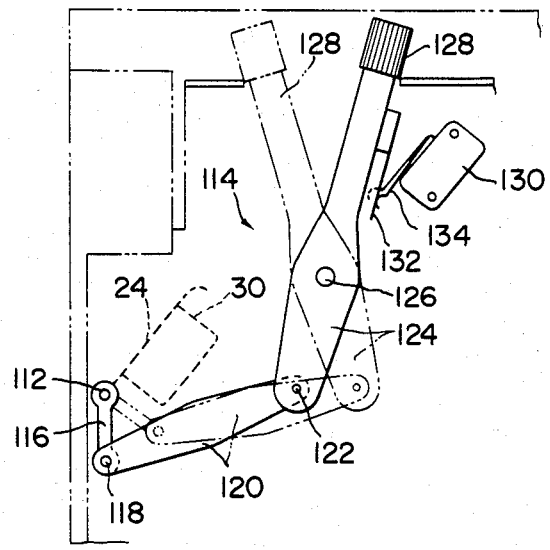
FIG. 4 is an enlarged elevation of a manual actuating mechanism for the damper used in the air conditioner.

FIG. 4 illustrates a manual actuating mechanism 114 for the damper 24. The manual actuating mechanism 114 includes an arm 116 rigidly anchored at one end on the pivot pin 112 of the damper 24 for joint pivotal motion therewith. The other end of the arm 116 is pin jointed at 118 to one end of a link 120, the other end of which is likewise pin jointed at 122 to one end of a hand lever 124. Medially pivoted at 126, the hand lever 124 has a knob 128 on the other end which projects out of the conditioner housing 10 for manipulation by the user.

A heater switch 130 is positioned adjacent the hand lever 124 of the damper actuating mechanism 114. The hand lever 124 has an abutment 132 secured thereto for movement into and out of abutting engagement with the actuator arm 134 of the heater switch 130.

It is clear from the foregoing discussion of FIG. 4 that the manual actuation of the hand lever 124 to the solid line position results in the pivotal motion of the damper 24 to the phantom horizontal position of FIG. 1. The damper 24, when in this position, places the cool air outlet 26 in communication with the air inlet 12. Also, when turned to the solid line position of FIG. 4, the hand lever 124 causes the heater switch 130 to deenergize the heater 30. When pivoted counterclockwise to the phantom position of FIG. 4, on the other hand, the hand lever 124 causes the damper 24 to pivot to the solid-line slanting position of FIG. 1 and hence to communicate the warm air outlet 28 with the air inlet 12. The heater switch 130 becomes closed upon counterclockwise turn of the hand lever 124, so that the heater 30 becomes energized to heat the airstream being discharged through the warm air outlet 28.

Figure 5:
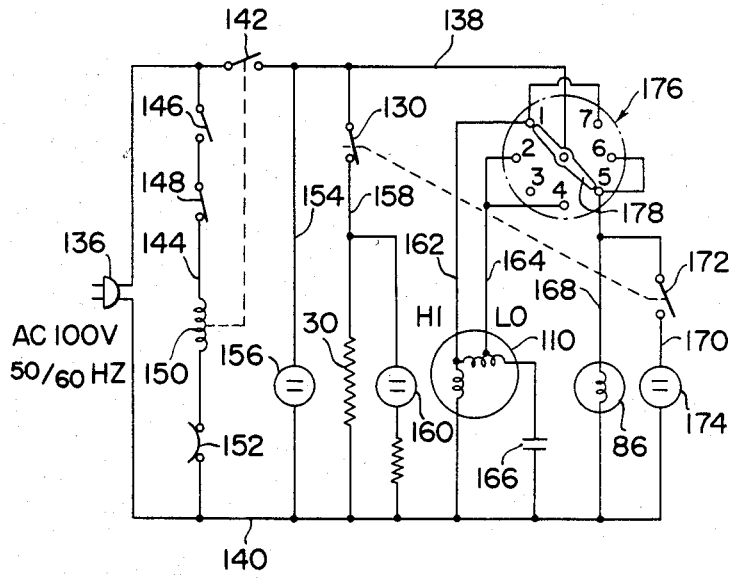
FIG. 5 is schematic diagram of a plug-in electric circuitry incorporated in the air conditioner.

FIG. 5 is a schematic diagram of a plug-in electric circuitry to be incorporated into the year-round air conditioner of the above-described mechanical construction. The circuitry has a plug 136 for insertion in a service outlet or the like. A pair of supply lines 138 and 140 are connected to the plug 136, with the supply line 138 having a power switch 142. Connected between the pair of supply lines 138 and 140 are:

1. A line 144 having a timer switch 146, a lid switch 148, a relay coil 150 associated with the power switch 142, and a current limit switch 152.
2. A line 154 having a POWER pilot lamp 156.
3. A line 158 having the heater switch or WARM switch 130, the heater 30 and, in parallel with the latter, a WARM pilot lamp 160.
4. Lines 162 and 164 having the fan motor 110 capable of operation at a high or low speed, and a capacitor 166.
5. A line 168 having the band motor 86.
6. A line 170 having a COOL switch 172 and a COOL pilot lamp 174.

As shown also in FIG. 1, the lid switch 148 on the line 144 is to be activated by the hinged lid 96 normally closing the aperture 94 through which the wet band assembly 20 is inserted in and withdrawn from the conditioner housing 10. The WARM switch 130 and the COOL switch 172 are coordinated with each other in such a manner that one is opened when the other is closed, and vice versa.

The circuitry of FIG. 5 further includes a rotary multicontact switch 176 for the on-off control of the two-speed fan motor 110 and the band motor 86. The rotary switch comprises an annular row of fixed contacts designated 1 through 7, and a dual movable contact 178 capable of simultaneous engagement with any two diametrically opposed fixed contacts.

The operational description of the year-round air conditioner follows. For the production of warm, moist air the user may close the power switch 142, operate the movable contact 178 of the rotary switch 176 into engagement either with the fixed contacts 1 and 5 or with the fixed contacts 2 and 6, and turn the hand lever 124 of the damper actuating mechanism 114 to the phantom position of FIG. 4.

The POWER pilot lamp 156 glows upon closure of the power switch 142. The simultaneous engagement of the movable contact 178 of the rotary switch 176 with the fixed contacts 1 and 5, or 2 and 6, results in the operation of both the band motor 86 and the fan motor 110. Driven by the fan motor 110 at high or low speed, the fan 22 draws room air into the conditioner housing 10 through the filter screen 36 at the air inlet 12. Within the housing 10 the filtered airstream A passes the wetted porous band 84 traveling over the pair of rolls 80 and 82, thereby to be both moistened and refiltered. Then the dust-free moist air enters the duct 104.

As the hand lever 124 of the damper actuating mechanism 114 is activated as above, the damper 24 pivots to the solid-line slanting position of FIG. 1, thereby placing the warm air outlet 28 in communication with the air inlet 12. Simultaneously the WARM switch 130 becomes closed by the hand lever 124 to cause the heater 30 to be energized and the WARM pilot lamp 160 to glow. Thus the heater 30 heats the filtered, moistened air as it flows through the warm air outlet 28 out into the room. Positioned at the relatively constricted part of the airflow path, the heater 30 can effectively heat the air to a required temperature range in spite of its limited capacity. Further, the damper 24 in its slanting position coacts with the air duct 104 to direct the stream of warm, moist air downwardly through the warm air outlet 28, toward the floor, for most efficiently heating the room.

For the production of warm air without humidification the user may operate the rotary switch 176 to move one of the arms of its movable contact 178 into engagement with either the fixed contact 4 or 7. Then only the fan motor 110 will be set into operation, with the band motor 86 held out of operation.

For cooling the room, on the other hand, the user may close the power switch 142, actuate the movable contact 178 of the rotary switch 176 into engagement either with the fixed contacts 1 and 5 or with the fixed contacts 2 and 6, and manipulate the hand lever 124 of the damper actuating mechanism 114 to the solid line position of FIG. 4. Thus the band motor 86 and the fan motor 110 are both set into operation as in the above described case of warm, moist air supply. Drawn by the fan 22 into the conditioner housing 10 through the filter screen 36 at the air inlet 12, the air passes the wetted porous band 84 thereby to be cooled by the evaporative cooling process, besides being refiltered.

The hand lever 124 when turned to the solid line position of FIG. 4 causes the damper 24 to pivot to the phantom horizontal position of FIG. 1. Thereupon the exit end 108 of the air duct 104 opens to the cool air outlet 26. The hand lever 124 also opens the WARM switch 130. As has been stated, the opening of the WARM switch 130 results in the closure of the COOL switch 172, with the consequent glowing of the COOL pilot lamp 174. After passing the air duct 104, the cool, clean air is directed by the damper 24 into and through the cool air outlet 26 out into the room.

It should be appreciated that the cool airstream encounters no obstacle at all on its way from fan 22 to cool air outlet 26. Accordingly the cool air will be produced noiselessly at a sufficiently high flow rate.

While one embodiment of the invention has been shown and described herein, it will be understood that it is illustrative only and not to be taken as a definition of the scope of the invention. A variety of modifications will readily occur to one skilled in the art on the basis of this disclosure. An example is the location of the heater 30. Although this heater is shown to be mounted on the pivotal damper 24 in the illustrated embodiment, it may be fixedly positioned anywhere at or adjacent the warm air outlet so as not to run counter to the objectives of the invention. This and other modifications or alterations of the invention may be resorted to within the broad teaching hereof; hence the invention should be accorded the full scope of the following claims so as to embrace any and all equivalent devices.

What is claimed is:

1. A year-round air conditioner capable of selective supply of cool and warm air, comprising:

(a) a housing having an air inlet and an air outlet defined therein;

(b) a water receptacle within the housing for containing water;

(c) a wet band assembly comprising an endless band of water-absorbent and air-permeable material capable of traveling, the endless band being arranged to be partly immersed in the water receptacle, thereby to be wetted, and to intervene between the air inlet and the air outlet in the housing;

(d) a fan within the housing for creating airflow from the air inlet to the air outlet through the endless band of the wet band assembly;

(e) a damper disposed at the air outlet in the housing and dividing the air outlet into a cool air outlet and a warm air outlet, the damper being pivotable about an axis between a first position where the cool air outlet is opened with the warm air outlet being closed and a second position where the warm air outlet is opened with the cool air outlet being closed, the damper extending obliquely across an air passage so as to change the direction of an air flow in the passage; and (f) a heater mounted on the surface of the damper and arranged to face the cool air when the damper is in the second position, and further arranged to be outside the air flow when the damper is in the first position.

2. A year-round air conditioner according to claim 1, wherein the damper extends horizontally across the air outlet in its first position, with the cool air outlet defined over the damper and the warm air outlet defined thereunder.

3. A year-round air conditioner according to claim 2, wherein the damper is pivotable about a horizontal axis, the damper when in the second position being effective to cause the warm air to flow downwardly out of the warm air outlet.

4. A year-round air conditioner according to claim 3, wherein the heater is mounted on that surface of the damper which is directed downwardly when the damper is in the horizontal position.

5. A year-round air conditioner according to claim 1 further comprising a tapering air duct mounted within the housing for guiding the airflow from the wet band assembly to the air outlet, the air duct having a larger entrance end open toward the wet band assembly and a smaller exit end open toward the air outlet, and wherein the damper is disposed adjacent the exit end of the air duct and coacts therewith to selectively communicate the cool air outlet and the warm air outlet with the air inlet.

6. A year-round air conditioner according to claim 1 further comprising a rotary switch capable of being adjusted so as to operate the fan without actuating the endless band.

7. A year-round air conditioner as claimed in claim 1 further comprising a hand lever to be manipulated for pivotally moving the damper.

8. A year-round air conditioner according to claim 7, further comprising a heater switch positioned to be activated and deactivated by the hand lever for setting the heater into operation when the warm air outlet is placed in communication with the air inlet by the damper, and for setting the heater out of operation when the cool air outlet is placed in communication with the air inlet by the damper.

* * * * *